United States Patent [19]

Gurries

[11] 4,324,551

[45] Apr. 13, 1982

[54] BOW-MOUNTED PROPELLER DRIVEN BOAT

[76] Inventor: Albert G. Gurries, 3540 Hecker Pass Rd., Gilroy, Calif. 94939

[21] Appl. No.: 220,404

[22] Filed: Dec. 29, 1980

[51] Int. Cl.[3] ..... B63H 16/14

[52] U.S. Cl. ..... 440/28; 440/62

[58] Field of Search ..... 440/21, 23, 24, 25, 440/26, 27, 28, 29, 30, 31, 32, 6–7, 51, 53, 62, 900; 114/144 R, 153; 74/480 B

[56] References Cited

U.S. PATENT DOCUMENTS

| | | | |
|---|---|---|---|
| 724,486 | 4/1903 | Milligan | 440/31 |
| 1,826,507 | 10/1931 | Crosby | 440/30 |
| 2,631,559 | 3/1953 | Jones | 114/153 |
| 3,211,125 | 10/1965 | Yarbrough | 440/31 |
| 3,440,995 | 4/1969 | Welsh | 440/28 |

FOREIGN PATENT DOCUMENTS

| | | | |
|---|---|---|---|
| 162317 | 5/1921 | United Kingdom | 440/30 |

*Primary Examiner*—Trygve M. Blix
*Assistant Examiner*—Jesus D. Sotelo
*Attorney, Agent, or Firm*—Townsend and Townsend

[57] ABSTRACT

A highly maneuverable, efficient boat having a bow-mounted propeller drive with a forwardly directed propeller for pulling the boat through the water. The forwardly directed propeller holds its own course so that the user does not have to steer except to change direction. The bow-mounted propeller is pivoted to change the direction of travel of the boat via a pair of foot-actuated steering pedals. Actuation of both pedals simultaneously causes the propeller drive to tilt back and be raised out of the water.

4 Claims, 4 Drawing Figures

BOW-MOUNTED PROPELLER DRIVEN BOAT

FIELD OF THE INVENTION

This invention is related to boats, particularly bow-mounted, propeller driven boats.

BACKGROUND OF THE INVENTION

Boats are often used for various purposes. One purpose for which many small boats are used is simply pleasure. Pleasure boats, to be truly enjoyable, should provide the user with a mode of water transportation which is simple and convenient to use and, most importantly, efficient.

One source of inefficiency in many small boats is the use of a rudder to steer the boat. To get around this, various propeller drives have been devised in which the propeller is pivotable about a vertical axis so that the propeller can be pointed in the direction of desired thrust. See, for example, U.S. Pat. Nos. 1,826,507; 2,487,195; 2,956,535; and 3,377,976. However, these prior art steerable propeller drives all required constant attention to steering by the operator.

SUMMARY OF THE INVENTION

The present invention provides a steerable propeller drive for which constant operator attention to keep the boat pulling straight ahead is not needed. Further, the boat provides for all operations to be accomplished by the operator while seated in a single position.

The boat has a bow-mounted propeller drive with a forwardly directed propeller for pulling the boat through the water. The propeller drive is typically hand-powered by a user sitting on a seat within the boat. A flexible drive cable connects the hand-crank apparatus and the propeller. The forwardly directed propeller holds its own course so that the user does not have to steer except to change direction. The bow-mounted propeller can be pivoted to change the direction of travel of the boat via a pair of foot-actuated steering pedals.

Actuation of both pedals simultaneously causes the propeller drive to tilt back and be raised out of the water. A catch bar locks the drive into its raised position. Releasing the catch bar, typically remotely actuated by the user by pulling a string attached to the bar, allows the propeller drive to be lowered back into the water.

A stern mounted keel acts as a wind stabilizer to keep the boat on course. The keel can be lifted up out of the water by user by a keel cord, an end of which is located near the seated operator.

A primary advantage of the present invention accrues from the forwardly directed propeller which efficiently pulls a boat through the water along a straight ahead path of least resistance. Thus, the operator need not constantly adjust the direction of the propeller drive while the boat is in motion. Being a bow-mounted propeller, great maneuverability is achieved. No relatively inefficient rudders are needed to change direction but rather the propeller is pivoted to propel the boat in the desired direction.

A number of features combine to allow the operator functions to be performed by the operator while sitting on a centrally located seat within the boat. The keel and propeller drive can be raised and lowered by actuating the keel cord and the foot pedals and catch bar string, respectively. Steering is through the selective actuation of one of the two foot pedals. The boat is powered by rotation of the hand-cranks on the hand-crank apparatus by the operator. In sum, the disclosed boat of the invention is an efficient, maneuverable and conveniently operated boat specially adapted for use as a simple pleasure craft.

Other features and advantages of the present invention will appear from the following description in which the preferred embodiment has been set forth in detail in conjunction with the accompanying drawing.

DETAILED DESCRIPTION OF THE PREFERRED EMBODIMENT

Figure 4:
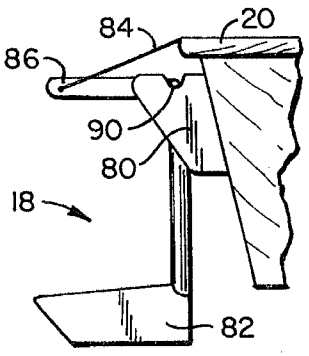
FIG. 4 is a partial side view of the boat of FIG. 1 showing the stabilizing keel.
Figure 1:
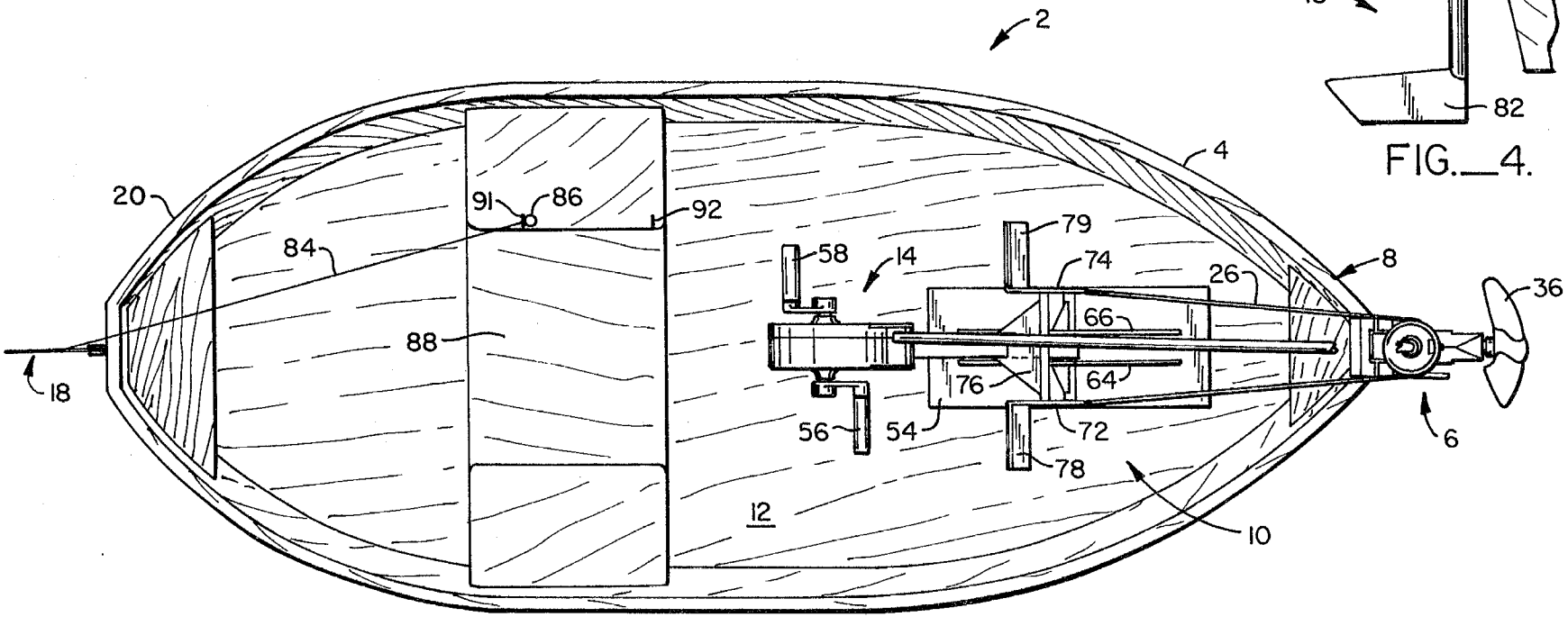
FIG. 1 is a top plan view of the boat of the present invention.
Figure 2:
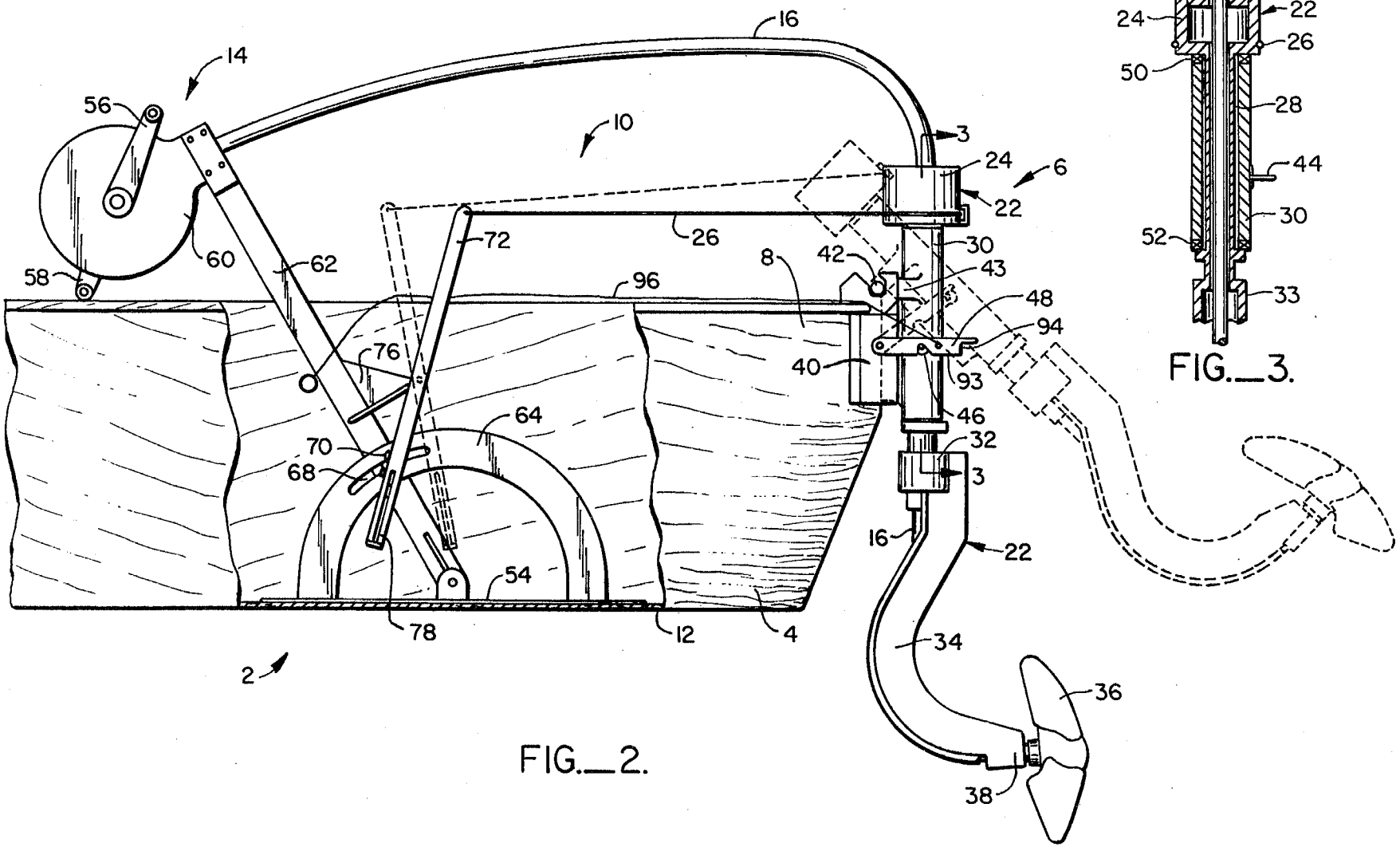
FIG. 2 is a partial side view of the boat of FIG. 1 showing the propeller drive, hand-crank apparatus and steering apparatus.

Turning now to FIGS. 1 and 2, the propeller driven boat 2 of the present invention includes generally a hull 4 to which is mounted a propeller drive 6 at the bow 8 of the boat, steering apparatus 10 mounted to the bottom 12 of the boat, and hand-crank apparatus 14 mounted centrally within the boat and connected to propeller drive 6 via a flexible drive cable 16. A stabilizing keel 18, shown best in FIG. 4, is mounted to the stern 20 of the boat.

Figure 3:
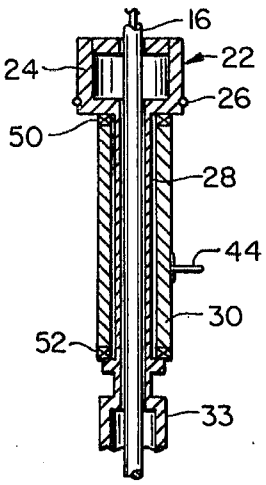
FIG. 3 is a cross-sectional view taken along lines 3—3 in FIG. 2.

As seen best in FIG. 3, propeller drive 6 includes a main housing 22 through which flexible drive cable 16 passes. Main housing 22 includes an enlarged upper portion 24 around which a steering cable 26 passes. A cylindrical upper intermediate portion 28 extends downwardly from enlarged upper portion 24 and is encased by a tube 30 described below. A lower intermediate portion 32 connects upper intermediate portion 28 with a curved lower portion 34. A propeller 36 is mounted to the outer end 38 of lower curved portion 34 for connection with the distal end of flexible drive cable 16.

The entire main housing 22 is mounted to a block 40 at the bow 8 via a pair of outwardly extending pegs 42, the pegs extending from arms 43 on tube 30. The propeller drive 6 is maintained in its vertical driving attitude by engagement of a pin 44, extending laterally from tube 30, within a first slot 46 in a pivoting catch bar 48 pivotally mounted to block 40. A pair of bearings 50, 52 allow housing 22 of the propeller drive, and thus propeller 36, to be pivoted within tube 30 thus allowing the direction of thrust of propeller 36 to be changed.

Hand-crank apparartus 14 is mounted to a plate 54 on bottom 12 of the boat. Apparatus 14 includes a pair of hand-cranks 56, 58 operably connected to a gear box 60. Gear box 60 mounted to a support 62, the lower end of the support pivotally mounted to plate 54. Support 62 passes between a pair of arcuate support guides 64, 66. Aligned arcuate slots 68 within support 64, 66 allow hand-crank apparatus 14 to be adjustably positioned in an appropriate height using a wingnut 70.

The steering apparatus 10 includes a pair of steering bars 72, 74 pivotally mounted centrally along their lengths to an extension 76 of support 62. Pedals 78, 79 extend laterally from the lower ends of steering bars 72, 74. Steering cable 26 is attached to the upper ends of steering bars 72, 74. Cable 26 is typically wound around upper portion 24 of main housing 22 at least once so that sufficient friction is developed between cable 26 and upper portion 24 to pivot propeller drive 6.

FIG. 4 shows stabilizing keel 18 mounted to stern 20 between a pair of mounting plates 80. When in the water, the blade 82 of keel 18 does not pivot but remains aligned along the axis of the boat. The keel is raised by pulling on a ring 86 connected to one end of a keel cord 84 which is attached at its other end to a rearwardly extending arm 86 of keel 18. The operator, sitting on seat 88, simply removes ring 86 from a hook 91 and pulls on ring 86 to pivot keel 18 about pivot 90. To keep it in its raised position, the user merely hooks ring 86 over a hook 92 adjacent seat 88.

Briefly, the procedure for operating the boat is as follows. Propeller 36 is driven by the operator turning hand-cranks 56, 58, while seated on seat 88. The boat is steered by the operator selectively pressing on either pedal 78 or pedal 79. This causes main housing 22 to rotate on bearing 50 thus changing the angle of attack of propeller 36. To raise the propeller drive 6, as shown in dotted lines in FIG. 1, the user presses on pedals 78 and 79 simultaneously thus pivoting propeller drive about pegs 42. In doing so pin 44 slides out of first notch 46 and rides along an edge 93 of catch bar 48 until it enters on end notch 94 of bar 48. Release of pedals 78, 79 allows catch bar 48 to support propeller drive 6 in the raised position. To lower the propeller drive, the user merely presses on pedals 78, 79 slightly to relieve some of the pressure from pin 44 and then pulls on a catch bar string 96 connected to catch bar 48 to allow the user to lower the propeller drive. The keel, which is maintained in its lowered position by its own weight, is raised and lowered through cord 84. Thus, it is seen that all of the operational steps can be performed by the operator while seated at seat 88 in the boat.

Modification and variation can be made to the disclosed embodiment without departing from the subject of the invention as defined in the following claims.

I claim:

1. A propeller driven boat for use on a body of water, said boat having a bottom, sides and a centrally located seat for a user, comprising:

a forwardly directed propeller drive mounted at the bow of said boat, said drive mounted for pivotal movement about a first, generally vertical drive axis and about a second, generally horizontal axis, said second axis extending transverse to the boat axis extending from the bow to the stern;

said propeller drive including a hand-crank assembly operably coupled to a propeller on said propeller drive;

said hand-crank assembly pivotally mounted on the floor and having means for adjustably securing said hand-crank assembly into position for convenient operation by the user on said seat;

steering means having a pair of pedals operably coupled to said propeller drive to selectively rotate said propeller drive about said first axis when one said pedal is actuated and to rotate said propeller drive about said second axis when both said pedals are actuated by the user to raise said propeller drive at least partially out of said body of water; and a remotely actuated keel means mounted to the stern of said boat.

2. A propeller driven boat for use on a body of water, said boat of the type having a bottom, sides and a seat comprising: a bow-mounted, hand-powered propeller drive, said propeller drive having a forwardly disposed propeller configured to pull said boat over said body of water and being pivotally mounted to said boat along a first axis generally parallel to said bottom, and foot-actuated steering means for changing the directional orientation of said propeller drive around a second axis generally normal to said bottom so that activating a first pedal moves said propeller drive around said second axis in one direction and activating a second pedal moves said propeller drive around said second axis in a direction opposite said one direction, and simultaneous activation of said first and second pedals moves said hand-powered propeller drive about said first axis to lift at least a portion of said propeller drive out of said body of water to a raised position.

3. A propeller driven boat for use on a body of water, said boat of the type having a bottom, sides and a seat comprising: a hand powered propeller drive being pivotally mounted to said boat along a first axis generally parallel to said bottom, and foot-actuated steering means for changing the directional orientation of said propeller drive around a second axis generally normal to said bottom so that activating a first pedal moves said propeller drive around said second axis in one direction and activating a second pedal moves said propeller drive around said second axis in a direction opposite said one direction, and simultaneous activation of said first and second pedals moves said hand-powered propeller drive about said first axis to lift at least a portion of said propeller drive out of said body of water to a raised position.

4. The boat of claims 2 or 3 including pivotal means for supporting said propeller in said raised position.

* * * * *